US006588165B1

(12) United States Patent
Wright

(10) Patent No.: US 6,588,165 B1
(45) Date of Patent: Jul. 8, 2003

(54) EXTRUSION DEVICES FOR MOUNTING WALL PANELS

(76) Inventor: John T. Wright, 19 Kratz Rd., Harleysville, PA (US) 19438

( * ) Notice: Subject to any disclaimer, the term of this patent is extended or adjusted under 35 U.S.C. 154(b) by 0 days.

(21) Appl. No.: 09/693,172

(22) Filed: Oct. 23, 2000

(51) Int. Cl.[7] ..... E04B 2/00; E04B 5/00; E04B 9/00

(52) U.S. Cl. ..... 52/506.05; 52/464; 52/459; 52/461; 52/465; 52/466; 52/468; 52/474; 52/506.05

(58) Field of Search ..... 52/459, 461, 465, 52/466, 468, 470, 474, 506.05, 509, 464

(56) References Cited

U.S. PATENT DOCUMENTS

| | | | | | |
|---|---|---|---|---|---|
| 3,199,258 | A | * | 8/1965 | Jentoft et al. | 52/282 |
| 3,688,460 | A | * | 9/1972 | Van Loghem et al. | 52/466 |
| 4,385,850 | A | * | 5/1983 | Bobath | 403/205 |
| 5,678,383 | A | * | 10/1997 | Danielewicz | 52/775 |

* cited by examiner

*Primary Examiner*—Carl D. Friedman
*Assistant Examiner*—Steve Varner
(74) *Attorney, Agent, or Firm*—Evelyn M. Sommer

(57) ABSTRACT

An extrusion device for mounting a wall panel has an outer cap extending to an edge on at least one side which is positioned against an outer surface of a wall panel, having a pair of spaced-apart insertion fingers, and a receiver base having a planar mounting portion and a pair of angled receiver flanges projecting upwardly to receive the insertion fingers therein. The two-piece extrusion permits wall panels to be mounted or removed from the underlying wall structure in on-sequential order. The receiver base and cap can be provided on both sides to form an "H" type extrusion, or on only one side in a "J" type extrusion. Preferably, the outer cap is made of metal, and the tips of the insertion fingers are beveled at a slight angle of about 7° to 14° to allow easy insertion into the receiver flanges. The cap has compound water-shedding edges formed with a rounded rain-drip edge spaced in close proximity to a sharply inclined knife edge. In another variation, a one-piece extrusion device has a rear base portion and a front cover portion forming a pocket therewith, and a ramp formed on the base portion within the width of the front cover portion for gradually forcing the edge of a wall panel inserted in the pocket toward the front cover portion clear of the heads of screws used to mount the base portion to the underlying wall structure. The base portion is formed with a hook indentation on a back side of the ramp on a rear surface of the base portion, and interconnects with a "Z" type extrusion having a hook end to form a right angle connection. The one-piece extrusion may be formed as a "J" (one-sided), "H" (two sided), "C" (corner), or other suitable types.

18 Claims, 5 Drawing Sheets

FIG. 8A
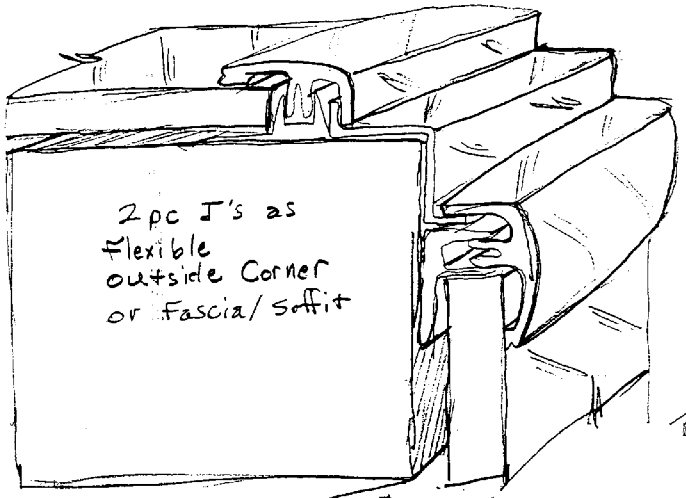
FIG. 8D
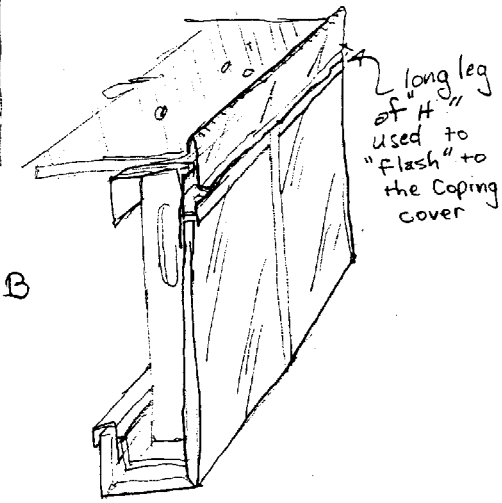
FIG. 8B
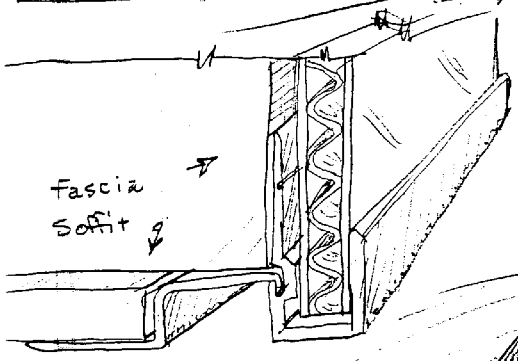
FIG. 8E
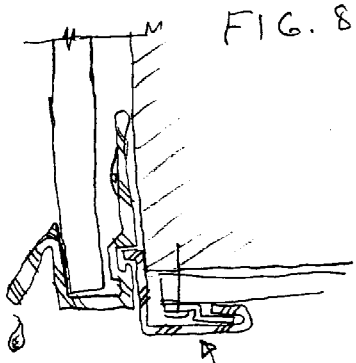
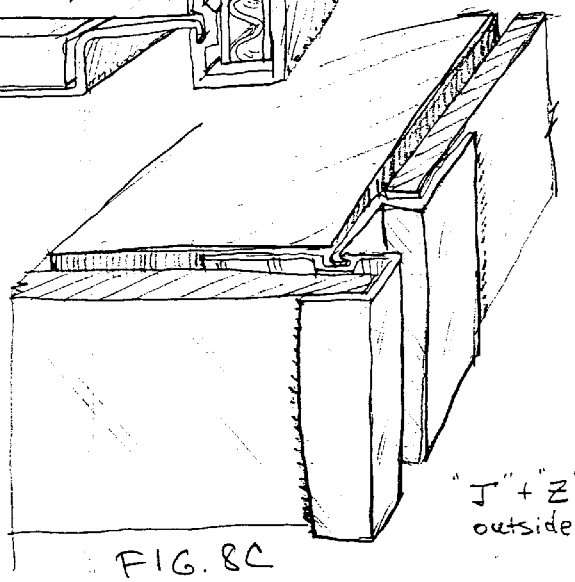
"J" + "Z" as adjustable outside corner
other metal pieces, brake-form shapes
FIG. 8C

EXTRUSION DEVICES FOR MOUNTING WALL PANELS

TECHNICAL FIELD

This invention generally relates to extrusion devices for mounting wall panels, and more particularly, to extrusions having features for facilitating panel mounting and removal, forming useful types of joints from a standard set of parts, and improving the sealing, weathering, and durability of wall panel installations.

BACKGROUND OF INVENTION

Wall panels are widely used to create a finished, durable, and aesthetic appearance on building walls of all types, as well as for panels for truck bodies, shipping containers, and the like. The panels are typically formed as laminates of outer surface sheets bonded to inner core layer or layers that have structural strength and rigidity, yet are light-weight, flexible under building and environmental stresses, and attractive for the external or interior appearance of building walls. The panels are mounted to building walls by various types of mounting devices. For example, one-piece channel-shaped extrusions of metal or rigid plastic are widely used to retain the panels at joints, corners, and boundary terr (breaks). With conventional extrusion designs, installation proceeds progressively by first installing a corner or terminal extrusion, then a panel, then an "H" (straight, two-sided) extrusion, then another panel, and so on until another corner of termination is reached. Installers must be able to size the panels, position the mounting extrusions, and form joints that are properly aligned and cleanly formed.

However, conventional extrusion devices have been rather inconvenient to use and expensive. With one-piece extrusions, installation proceeds in one direction along a building wall, and caulking the gaps between the panel edges and the extrusions must be done at the time of installation. If the panels are misaligned or a panel becomes damaged, the panels must be removed in sequence in the backward direction. An individual panel cannot be removed out of sequence. The already-installed caulking must be removed or it will detract from the clean appearance of the panels. With one-piece extrusions, the panel fitting and caulking must be done correctly the first time of installation. Installers may be tempted to leave out the caulking to facilitate panel repair or removal, but this can lead to panel and building failure due to water seepage through the gaps and into the building walls.

Conventional one-piece extrusions are frequently attached to furring, framing, or sheathing members on building walls by screw fasteners inserted or drilled through a rear portion of the extrusion. If they are not properly countersunk, the heads of the screw fasteners can project above the plane of the extrusion channel and get in the way of insertion of the edge of the panel therein. The conventional extrusions are also pre-formed to accommodate a single thickness of wall panel, and therefore the number of extrusion parts that must be stocked is multiplied for handling several wall panel thicknesses. Conventional extrusions are also formed in a fixed set of shapes, such as "J", "H", and "Z" shapes, for mounting panel ends, straight joints, or corners, respectively. However, these extrusion parts cannot be used to make a clean, rigid fascia/soffit transition or non-standard angle or corner.

SUMMARY OF INVENTION

In accordance with the present invention, an extrusion device for mounting a wall panel to an underlying wall structure comprises: an outer cap provided with an outer surface extending to an edge on at least one lateral side thereof adapted to be positioned against an outer surface of a wall panel, said outer cap having a pair of spaced-apart insertion fingers projecting perpendicularly downward from an inner surface of said cap, and an inner receiver base having a planar mounting portion for mounting to an underlying wall surface and for receiving an end of a wall panel to be mounted thereon, said receiver base having a pair of angled receiver flanges spaced apart by a given width and projecting upwardly from an inner surface facing toward said cap, so as to receive the insertion fingers of said cap therein when said cap is positioned and inserted onto said base.

In a preferred embodiment of the invention, referred to as a two-piece "J" type extrusion, the receiver base and cap have mounting and panel holding portions on both sides of a central portion where the insertion fingers and receiver flanges are engaged. The receiver base and flanges are made of plastic and configured to yield under the force of inserting the insertion fingers. The outer cap and insertion fingers are made of metal so as to match the typical metal face sheets of wall panels. The tips of the insertion fingers are beveled at a slight angle $\alpha$, preferably from 7° to 14°, to allow easy insertion of the fingers into the receiver flanges. The receiver flanges are formed with beveled outer contact surfaces inclined toward tip ends facing a center cavity into which the insertion fingers are inserted, in order to center and guide their gradual insertion therein.

Other features of the invention include the cap having compound water-shedding edges with a rounded rain-drip edge spaced in close proximity to a sharply inclined knife edge. The knife edge scrapes water running downwardly onto the cap away from the panel surface, and the rain-drip edge at a lower side of the cap forms a meniscus and drip line away from the panel surface. The insertion fingers have a thickness that increases slightly with insertion for gradual spreading of the receiver flanges, thereby causing the grip strength of the receiver flanges to increase as the insertion fingers move progressively farther into the receiver flanges. The insertion fingers have on their outer surfaces a plurality of detent positions for engagement of the receiver flange tips therein, in order to accommodate differing panel thicknesses.

Another variation of an extrusion device, referred to as a contrast-cover two-piece "H" type extrusion, has a similar receiver base, an insert cap provided at its inner facing side with an insertion plug which is inserted between the receiver flanges, and a cover cap which snaps into a cavity formed on a front facing side of the insertion plug.

Another extrusion variation, referred to as a two-piece "J" type, has a receiver base with similar receiver flanges and a wall mounting and panel holding portion on only one lateral side thereof. A similarly one-sided cap has similar insertion fingers and an overlying portion on only one side thereof, said cap being provided on side thereof with a terminal flange that is offset by a slight distance from the receiver flange of the base.

In another aspect of the invention, a one-piece extrusion has a rear base portion of extended width for mounting to an underlying wall structure and holding the edge of a wall panel thereon, a front cover portion having a given width and being spaced from the base portion so as to form a pocket therewith, and a ramp formed on a front facing surface of the base portion within the width of said front cover portion, such that the ramp acts to gradually force the edge of a wall panel inserted in the pocket toward the front cover portion of the extrusion clear of the heads of screws used to mount the base portion to the underlying wall structure.

A further improvement available for panels with varying thickness is the double ramp design. Particulary suited to water insensitive panels. The first ramp pushes the panel towards the front for the screw head clearance, the second ramp allows panels from 0.385 to 0.281 thick to be pushed towards the front of a snug fit desirable for a clean appearance. In addition the second ramp provides for a "weep" space at the bottom to drain moisture leakage in so called Weep and Drains Systems.

In a preferred embodiment, the pocket depth (front cover width) is about 0.50 inch, and the ramp is located about midway in the pocket depth at about 0.25 inch. The extra pocket depth and ramp can give the installer the option to install a thicker panel within the pocket but short of the ramp. Providing the base portion with a long back leg allows the extrusion to deform Slightly so that the thicker panels will fit even if the fastener heads are not countersunk.

Another variation referred to as a one-piece "J" type extrusion similarly has a base portion which extends on only one side, a front cover portion on the one side, and a ramp having the panel-holding, screw-clearing function as described above. This "J" type extrusion is used to terminate the edge of a wall panel. A variation of the one-piece "J" type extrusion has an extension from the edge of the pocket that can be used to form a beveled inside corner or a horizontal flashing at the end of a wall or down to the ground level.

A further variation is a "Z" type extrusion which has a connector section with a hook end, a right angle intermediate section, and a straight section extending in parallel with the connector section. The hook end is designed to interconnect with the hook indentation of the ramp of a one-piece extrusion, such as the "H" or "J" type extrusion described above, in order to form a right angle connection thereto. A one-piece "C" type extrusion has two halves that form pockets for wall panels on each side of a right angle inside or outside corner. A straight "reveal-H" type extrusion can also be bent as to form an inside or outside corner over a wide range of angles. The described types of extrusions can be combined together to deal with many different kinds of panel edge situations of a building, such as combining two "J" extrusions to form an outside corner, or "J" and "Z" extrusions to form a fascia and soffit.

Other objects, features, and advantages of the present invention will be explained in the following detailed description of the invention having reference to the appended drawings.

BRIEF DESCRIPTION OF DRAWINGS

FIGS. 8A–8E show different types of extrusions that are combined to deal with different panel edge situations

DETAILED DESCRIPTION OF INVENTION

In the following detailed description, certain preferred embodiments of two-piece and one-piece extrusion devices for mounting wall panels are described. However, it is to be understood that these embodiments are intended only as examples of implementation of the principles of the present invention, and the full scope of the invention is not limited to these examples.

Figure 1A:
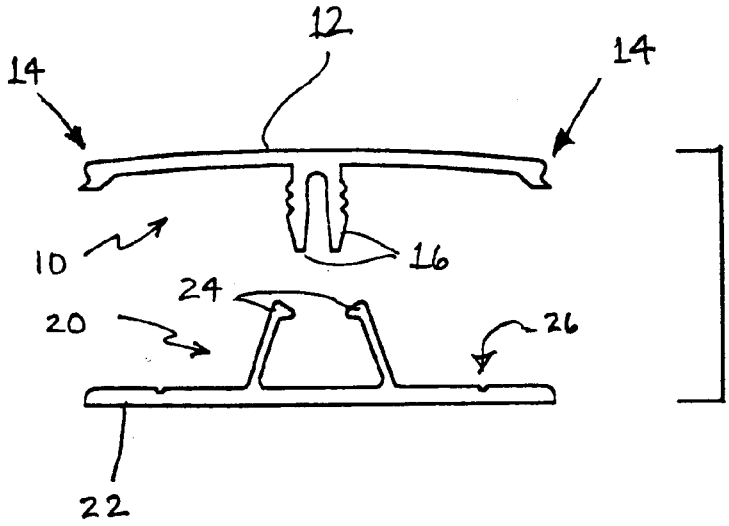
FIG. 1A shows two components of an "H" type extrusion in accordance with the present invention.
Figure 1B:
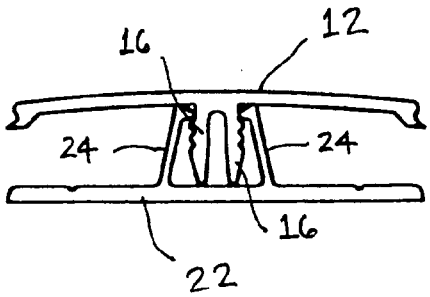
FIG. 1B shows the two components assembled together.

Referring to FIGS. 1A and 1B, a preferred embodiment of a two-piece, straight-type (referred to as "H" type) extrusion is shown having an outer cap 10 provided with a radiused outer surface 12, compound water-shedding edges 14 on opposite lateral sides thereof, and a pair of spaced-apart insertion fingers 16 projecting perpendicularly downward from an inner surface of the cap 10, and an inner receiver base 20 having a planar mounting portion 22 for receiving an end of a wall panel mounted thereon. The receiver base has a pair of angled receiver flanges 24 spaced apart by a given width W and projecting upwardly from a surface facing toward the cap, so as to receive the insertion fingers 16 of the cap 10 therein when the cap is positioned and inserted onto the base 20.

Figure 1C:
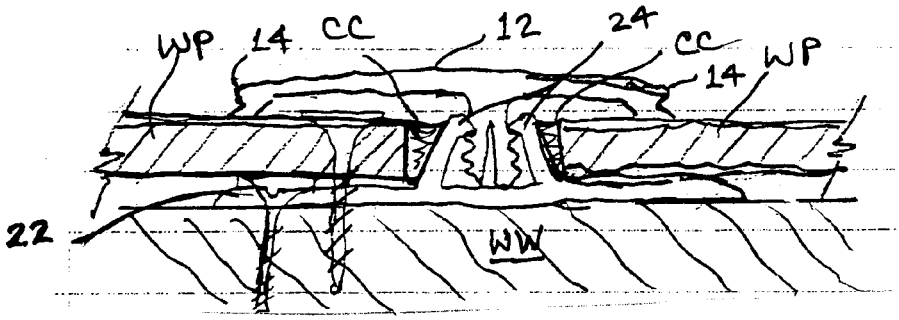
FIG. 1C shows the extrusion mounted at a joint between two wall panels.

As shown in FIG. 1C, the extrusion unit is used by fixing the mounting portion 22 with a screw to an underlying wall WW or wall anchoring member (furring, framing, or sheathing), then fixing the edge of a panel WP on one side to the mounting portion 22 with a screw, positioning the edge of a panel WP on the opposite bifurcated side (with its other edge fastened by a screw at the next extrusion unit), and joining the cap 10 to the base 20 by inserting the insertion fingers 16 into engagement with the receiver flanges 24 and pushing them all the way in. The screw-finder line 26 allows the installer to positively locate the proper position for the fasteners to fasten the base 20 to the wall WW.

Caulking CC is applied to seal the "V" spaces between the edges of the panels WP and the angled receiver flanges 24, either at the time of installing the panels, or later after all the panels have been installed. This location of the sealant line is remote from the exposed panel surfaces, so there is little chance that a messy applicator will get caulk on the faces of the panels. Caulk in this location is also easily removed for repairs and is protected from degradation from sun and weather.

The two-piece extrusion allows the caps to be readily removed to expose the panel edges, such that whole panels may be removed at any time and in any order. Thus, any panel damaged before a job is completed can be easily replaced. Access to building components hidden by a panel can be accomplished in the same way. Panels damaged during the life of a building can be removed and repaired off-site or replaced if needed. Replacement or different panels can be installed at a later date using the same extrusions, or the extrusion caps can be replaced without having to remove the panels. Thus, the paneled surface of a building can be easily maintained, and the building can be readily upgraded at a later date.

Typical wall panels have metal sheets on two sides bonded to a plastic, foam, or wood core in between. The metal sheets are perfect vapor barriers that will not allow moisture to escape from behind the panels. A vapor venting space is required to vent moisture coming through the building wall from the interior spaces, so that the moisture is not trapped by the metal faced panels. The base portion 22 of the extrusion, which is mounted on the underlying wall structure, such as furring, sheathing, or framing, has a thickness which acts to hold the wall panel slightly away from the wall structure to create a vent space. Mounting the wall panels on the base portion also allows the panel face to float to a true plane, and not to be forced to follow the wall contour which may be uneven.

The extrusions are produced in standard linear lengths corresponding to the lengths of the panels, and can be cut to fit any desired run length. The extrusions may be installed vertically or horizontally on a wall. Typically, extrusions are installed vertically to hold the panels to the wall, and horizontally to terminate the upper and lower edges of a line of panels. With the two-piece extrusions, the installer has the option to install all the bases first at the positions of the joints and the panels thereafter, or the bases and panels can be installed in sequence with each panel inserted as a gauge to install the next base. The caulking of the panels and insertion of the caps can be done at any time, either with the installation of the panels or later.

Wall panels having aluminum (or other metal) face sheets are commonly used to finish the exterior surfaces of building walls. The caps of the extrusions for mounting these panels are therefore preferably made of the same metal material for a closely matched appearance. The material for the bases is preferably a rigid plastic with some degree of flexibility for fitting and fastening the bases over uneven wall surfaces and to allow easy drilling and securing of screws through the base mounting portions.

Figure 2A:
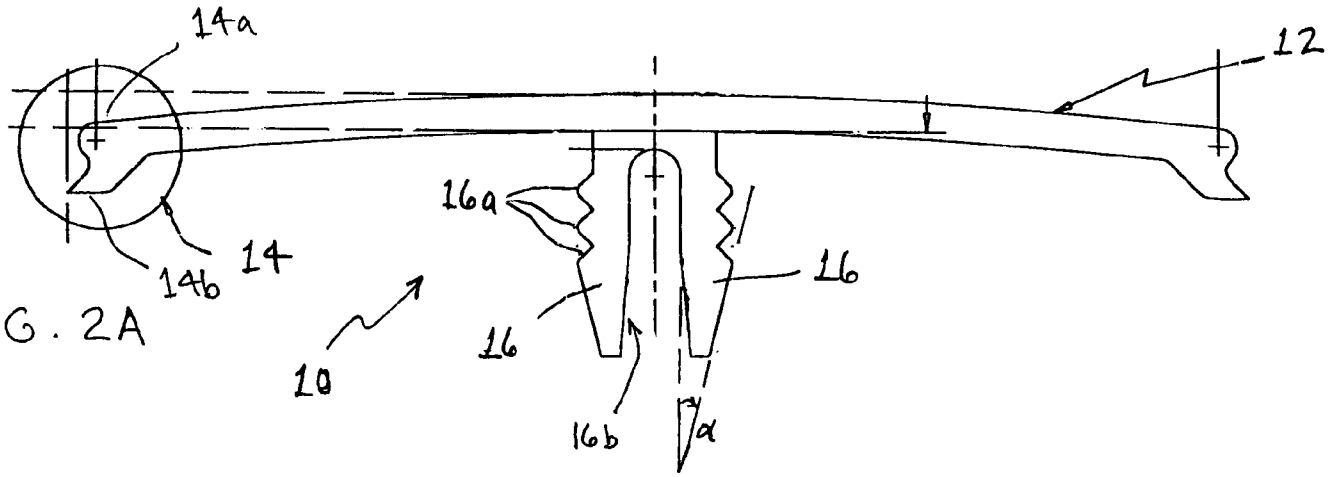
FIGS. 2A and 2B show the two components of the "H" type extrusion in greater detail.
Figure 2B:
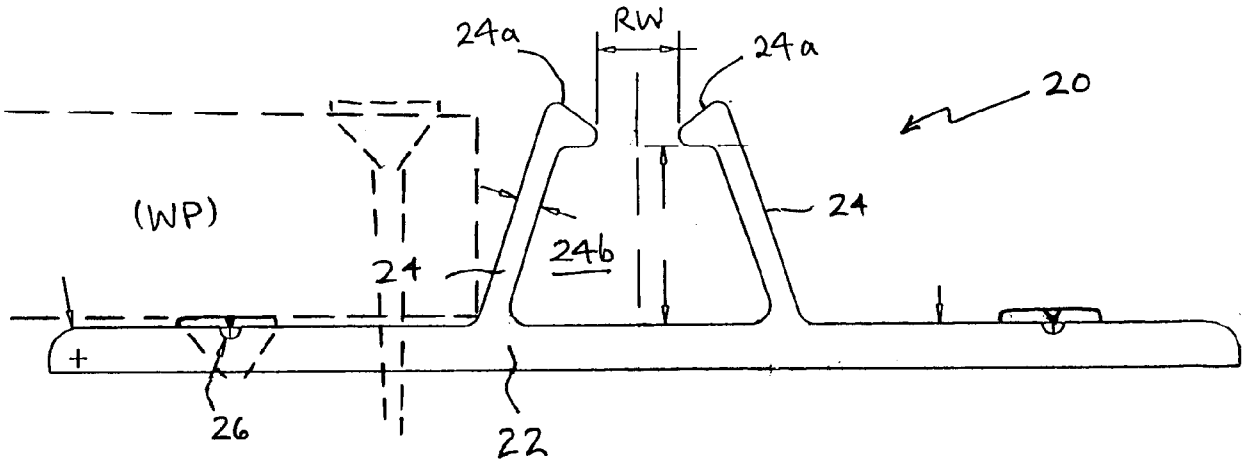

As shown in greater detail in FIGS. 2A and 2B, the tips of the receiver flanges 24 of the base 20 and the insertion fingers 16 of the cap 10 are designed to engage in a manner such that substantially the same force is required to insert the cap as to remove it. The receiver flanges, being made of plastic, are configured to yield under the force of inserting the insertion fingers, and to exert an elastic retaining force on detent positions 16*a* formed on the insertion fingers. The depth of the detent positions 16*a* are substantially the same, and the amount of "receiver spreading" required to remove the insertion fingers is designed to be substantially the same as the amount required to insert the insertion fingers. This design requires tighter tolerances and a unique arrangement of the components to allow standard manufacturing tolerances for the aluminum and plastic parts to produce reliable fits. In contrast, some conventional extrusions have a one-way design where the extrusion covers cannot be removed or must be forced or broken off, frequently resulting in the panels becoming damaged. The present design for a low insertion/removal force allows the cap to be easily removed without special tools.

The tips of the insertion fingers 16 are beveled at a slight angle $\alpha$, preferably from 7° to 14°, to allow easy insertion of the fingers into the receiver flanges 24. Too great an angle, e.g., 45°, requires too high an insertion force that the caps have to be pounded in. Too small an angle would produce too small an amount of "receiver spreading" for a given insertion length of the insertion fingers. Since the panels have specified thicknesses, and the caps cannot have a bulky profile, the insertion fingers are limited in their total length. At a bevel angle of about 14°, there is a good balance between easy insertion and a desired amount of "receiver spreading" so that the receiver flanges can exert a desired elastic retention force on the insertion fingers. The ends of the insertion finger tips may be rounded with a radius to facilitate the start of insertion into the receiver flanges.

The insertion control angle could be formed on either the insertion fingers 16 or the tips of the receiver flanges 24. However, since an aluminum part can hold critical dimensions better than a plastic part, it is preferred to form the insertion control angle on the tips of the insertion fingers. The receiver flanges are made of plastic material, so they can be formed with the non-critical shapes. The plastic material of the receiver flanges also forms a good seal with the caulk line injected in the "V" groove between the angled receiver flanges 24 and the abutting wall panel WP. The receiver base can be made of a relatively soft PVC plastic that allows the fasteners to be fastened readily therethrough, and also the fastener heads to self-countersink into the extrusion. This allows contractors to use inexpensive drywall screws without having to drill and countersink the holes, thereby cutting down installation time by as much as two-thirds.

The receiver flanges 24 have ends 24*a* spaced a part a width RW and formed with beveled outer contact surfaces inclined toward tip ends facing a center cavity 24*b* into which the insertion fingers are inserted. The inclined contact surfaces center the insertion fingers over the flanges and help guide their gradual insertion therein. This makes finding the center of the receiver much easier for the contractor, resulting in faster installation and reduced labor cost. The compound water-shedding edges 14 of the cap 10 also allow a contractor to grip the extrusion cap 10 more securely while centering and tapping it into place, and also for removal. Tipping of the cap off center is very apparent with a flat-faced cap shape. The curved outer radius of the cap 10 tends to minimize appearance problems in the event the cap becomes tipped.

Aluminum extrusion design requires that the thicknesses in thin-walled parts such as these be of equal thickness. Plastic extrusion design requires somewhat the same or else sink marks occur on the visible surfaces and make the part unsightly. The requirements of the die design for the space between the flanges of the receiver requires that a wide shape for the insertion fingers be provided. A single, wide insertion finger would be much thicker than the overall extrusion wall thickness. The insertion element is designed to have two fingers of the nominal extrusion wall thickness, and spaced apart enough to provide a closed cavity space 16*b* between the fingers adequate to allow proper die support and design.

Considering the strength of the fingers, the fingers are shaped such that after insertion is easily started by the insertion control angle $\alpha$, the thickness of the fingers is increased slightly for gradual spreading of the receiver flanges 24, causing the grip strength of the receiver flanges to increase as the insertion fingers move progressively farther into the receiver flanges. The build up in grip force of the receiver flanges is highly desirable to grip the thin panels tightly. The extrusion thus easily initiates engagement and insertion, and builds up grip strength as the insertion progresses. This provides a secure resistance to wind pull-off rivaling a solid extrusion. Maintaining a high pull-off resistance to wind is desirable in architectural applications.

The extrusion is also designed to accommodate different thicknesses of panels, so that the separate units do not have to be designed, manufactured, and stocked on site. The nominal panel thicknesses may be gauged in increments of 0.05" thickness. Therefore, a plurality (3 in FIG. 2A) of distinct detent positions 16*a* are provided on the surfaces of the insertion fingers 16 for engagement of the receiver flange tips, in order to accommodate the differing panel thicknesses. It is desirable that these detent positions be distinct and self-centering so that as the cap 10 is pressed into the receiver flanges of the base 20, the cap does not tip and remains in parallel position to the outer faces of the panels.

The detent positions 16*a* are shaped as a series of sine-wave detents. The tips of the flanges are designed to match the concave troughs of the sine wave, so as to cause the tips to self-center into the sine-wave detents and overcome the friction forces of the plastic part against aluminum. With the panels in place, the cap is prevented from tipping outside the range of the self-leveling feature by the width of the cap and ends contacting the outer surfaces of the panels.

In the industry, extrusions can be made of a variety of materials, such as plastics, roll form sheet, extruded aluminum, etc. The surfaces of the panels and the extrusions should have similar coatings and service lifetimes, so that they remain matched even as time passes. The use of aluminum outer surfaces allows desired paint finishes to be selected by the customer. Plastic caps would be less expensive than aluminum, but would not weather the same as aluminum-skinned panels and would require different paints and have different service characteristics. Thus, the choice in the present invention of using aluminum for the caps and plastic for the bases and providing insertion and gripping mechanisms that accommodate the characteristics of the bi-material parts provides the best combination of features for aesthetics, customer choice, easy of installation, and functionality.

The water-shedding compound edges 14 of the caps 10 have a rounded "rain-drip" edge 14*a* and a sharply inclined "knife" edge 14*b* which serve the important function of leading water away from the building or from entering the joints. For extrusions mounted horizontally, water running down the face of a panel is scraped away by the knife edge 14*a* in contact with the panel surface, causing the water to run over the face of the extrusion cap down to the lower rain-drip edge of the extrusion. Here water collects by meniscus forces until a drip builds up and falls. Because the rain-drip edge 14*a* is spaced from the knife edge in contact with the panel surface, the water falls away from the building or away from the next panel below, conventional extrusion designs have a flat face which allows water to course over the extrusion and continue to run down the building. This leads to more water buildup and a higher potential for water entering the building or a lower panel joint.

A further advantage of the rain-drip edge 14*a* is control of soiling of the building face. Water carries with it dust and chemicals from the atmosphere. If water is allowed to run freely down the surface, it deposits the dirt and chemicals onto the face of the building panels leading to an unsightly soiled buildup. The compound edge 14 causes water to be scraped from the panel surface and to drip free from the surface of the panel.

The compound water-shedding edges provide a thicker profile than conventional flat faced extrusions. However architectural designers do not want extrusions to look like battens. The two edge components produce a shadow line effect which tends to hide the depth of the edges, so that it is more architecturally pleasing. Because the rain-drip edge 14*a* is rounded, it presents a visible edge to the extrusion cap. The space between it and the panel surface appears like a shadow line, such as might occur next to a raised edge. The start of the knife edge 14*b* is interpreted by the eye as the end of a normal shadow. The net effect is that the extrusion is read as having a profile of only one-third of the actual depth, thus giving the appearance of a low profile cap, yet providing the water-shedding features not provided in a low profile cap.

The compound edge also makes it easier to grip the extrusion cap when seating it into place or for removal. The combination of the two edges produces a reticulated joint with two edges instead of one, and the rounding of the rain-drip edge combined with the rounding of the cap's surface serve to endure and deflect impacts which might dent or mar the surface. Due to its reflection of light at varying intensities, the curvature of the caps also serve to mask slight color and texture differences between the sheet metal surfaces of the panels and the extrusions. If screws or nails are used to fasten the panels to furring or sheathing at the edges of the panels near the joint line, the full section depth of the extrusion cap provides space to cover over any screw or nail heads that stick up above the surface of the panels, as well as any unsightly dimples caused by over-driven fasteners. Covering the heads is easier and saves time as compared to countersinking the heads into the face of the panels.

Figure 3A:
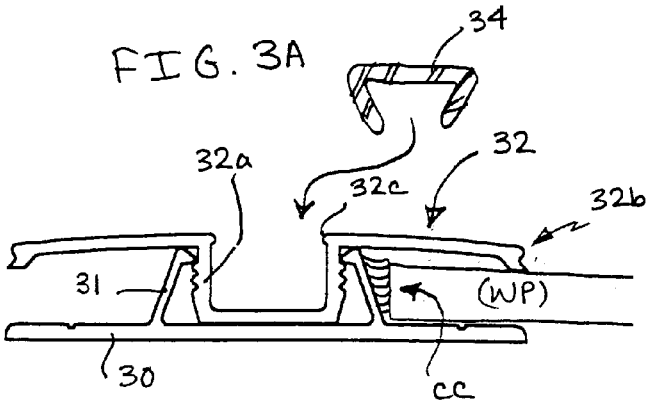
FIG. 3A shows a variation of the two-piece "H" type extrusion.

Referring to FIG. 3A, another variation of an extrusion device of the present invention, referred to as a contrast-cover two-piece "H" type extrusion, is shown having a receiver base 30 (similar to that described for the two-piece "H" type), an insert cap 32, and a cover cap 34. Instead of a pair of spaced-apart insertion fingers, the insert cap 32 in this embodiment has an insertion plug 32*a* which is inserted into the space between the receiver flanges 31. The insertion plug 32*a* is formed with the beveled edges for the insertion control angle and the series of self-centering detent positions as described previously. The insert cap 32 also has the compound water-shedding edges 32*b*. The cover cap 34 is a color-coordinated plastic piece which snaps into the cavity on the front facing side of the insertion plug 32*a* behind the retaining nubs 32*c*.

Figure 3B:
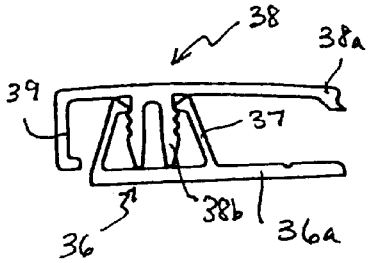
FIG. 3B shows another variation of a two-piece "J" type extrusion.

In FIG. 3B, another extrusion variation, referred to as a two-piece "J" type, has a receiver base 36 with receiver flanges 37 (as described previously) and a wall mounting and panel retaining portion 36*a* on only one side thereof. A similarly one-sided cap 38 has a pair of insertion fingers 38*b* (as described previously), and an overlying portion with compound edge 38*a* on only one side thereof. The other side of the cap 38 is provided with a brake or terminal flange 39 that is offset by a slight distance from the receiver flange 37 of the base 36. The offset can be used to conceal the edges of a connector piece extending between the terminal end of the panel and another section of the building wall. For example, two"J" extrusions can be used to terminate respective panel ends at an outside corner of a building wall, and a right-angle edge liner can be installed to cover the corner with ends extending under and being concealed by the offset in the "J" extrusions.

The two-piece extrusion allows the wall panels to be installed non-sequentially. That is, first the base portions of the extrusions can be mounted, to the underlying wall structure along measured joint lines, the panels can be mounted onto the base portions by applying fastener elements at the edges near the joint lines, the edges of the wall panels abutting the receiver flanges can be caulked, and then the cap portion can be inserted in place onto the base portions, covering the edges of the wall panels and the fastener heads. In contrast, one-piece extrusions require that the wall panels be installed sequentially, with each extrusion followed by a panel, followed by an extrusion.

Another improvement in extrusion devices according to the invention is described below with reference to one-piece extrusions. The one-piece extrusions are made of metal for mounting and holding a metal-faced wall panel therein. Its principal feature is the provision of a ramp on the back surface of the base portion of the extrusion for lifting the panel into a secure mounting position clear of screw fasteners used to mount the.extrusion to the underlying wall structure.

Figure 4A:
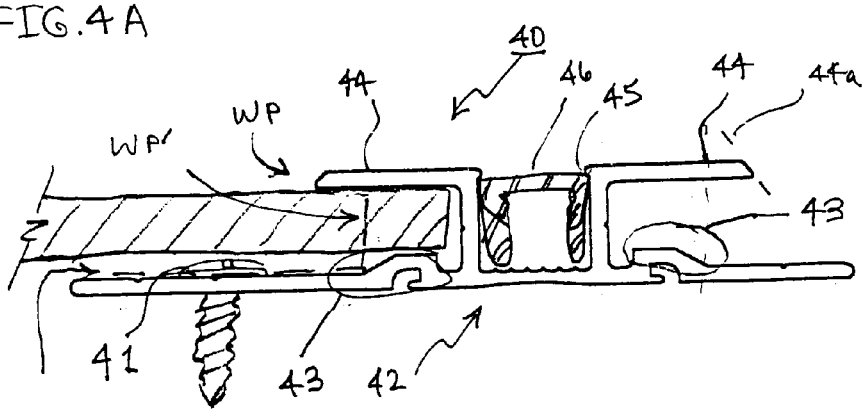
FIG. 4A shows a one-piece contrast-cover "H" type extrusion having a ramp feature.

Referring to FIG. 4A, a one-piece contrast-cover "H" type extrusion 40 has a rear base portion 42 of extended length on two lateral sides for mounting to an underlying wall structure and holding the edges of panel walls thereon, a front cover portion 44 having a given width and being spaced from the base portion so as to form a pocket therewith, and a ramp formed on a front-facing surface of the base portion 42. With one-piece extrusions, flat head or pan head self-drilling screws 41 are used to attach the extrusion to the underlying wall furring, framing, or sheathing. The heads of the fasteners can get in the way of the panel if they are not properly countersunk. The ramp 43 is provided to gradually force the edge of the wall panel toward the front of the extrusion. This provides a snug fit to hold the panel edges in the extrusion, and also provides space 41*a* to clear the panel from the screw heads, thereby avoiding the need to countersink the screws. The back side of the ramp 43 has a hook indentation which is used to connect with other connection pieces to form corners and soffit sections (described further below) The front cover portion has a front cavity 45 into which a cover cap 46 of contrasting color or texture is fitted.

The preferred embodiment is provided with a pocket of sufficient depth so that the ramp is located well within the width of the front cover portion 44. For example, the pocket depth (front cover width) may be a full 0.50 inch, which is deeper than the depth used in conventional one-piece extrusion. The ramp can be located about midway in the pocket depth at about 0.25 inch. The extra depth and presence of the ramp allow the edges of the wall panel to be securely held within the pocket of the extrusion. The deeper pocket can hide out-of-square cuts, rough cuts, burrs, and other edge defects. To avoid the metal face sheet catching on the exposed edge of the front cover portion, the ramp serves as a funnel entry point that feeds the panel from the back toward the front. Furthermore, the extra pocket depth and ramp can give the installer the option to install a thicker panel WP' (shown in dashed lines) within the pocket but short of the ramp 43. Providing the base portion 42 with a long back leg allows the extrusion to deform slightly so that the thicker panels will fit even if the fastener heads are not countersunk. The front cover portion 44 has an inclined knife edge 44*a* formed at the edge in contact with the surface of the wall panel for shedding any water coursing down the panel.

Figure 4B:
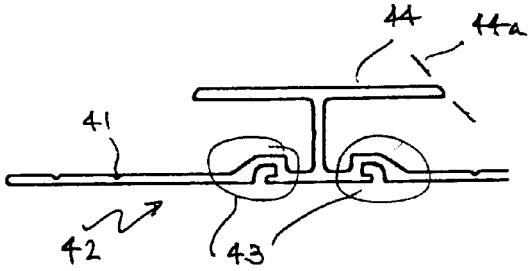
FIG. 4B shows the "H" type extrusion without the contrast cover piece.

In FIG. 4B, a variation of the one-piece "H" type extrusion has a similar structure but without a front cavity for a contrast cover piece.

Figure 5A:
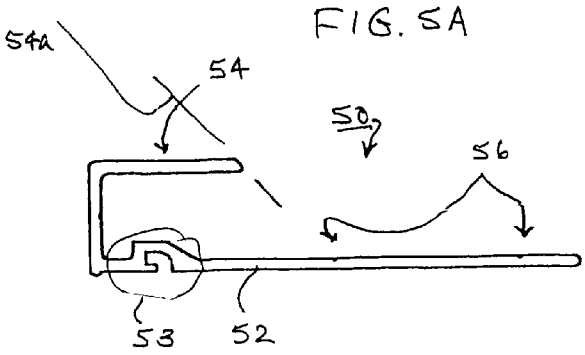
FIG. 5A shows a one-piece "J" type extrusion having the ramp feature.

In FIG. 5A another variation referred to as a one-piece "J" type extrusion 50 similarly has a base portion 52 extending on only one side, and a front cover portion 54 on the one side. The base portion 52 has a ramp 53 having the same panel-holding, screw-clearing function as described above. Screw finder rows 26 are provided to help the installer locate the screws in the correct position. The front cover portion 54 has an inclined knife edge 54*a* for shedding water from the surface of the panel. This "J" type extrusion can be used to terminate any edge of a wall panel.

Figure 5B:
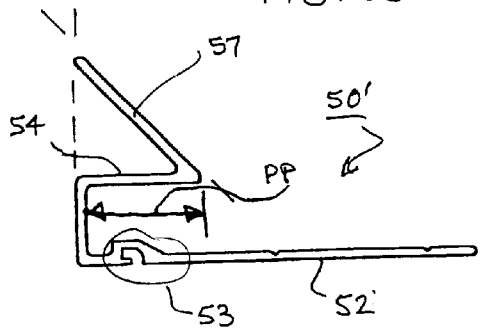
FIG. 5B shows a variation of the "J" type extrusion with a corner extension.

In FIG. 5B, a variation of the one-piece "J" type extrusion 50' has an extension 57 which extends from the edge of the pocket PP formed by front cover portion 54 to the outer boundary of the pocket wall. This type of extrusion can be used to terminate a wall panel and form a beveled inside corner with another surface at a right angle to the wall panel, or to form a water-shedding flashing at the bottom end of a wall or down to the ground level.

Figure 6:
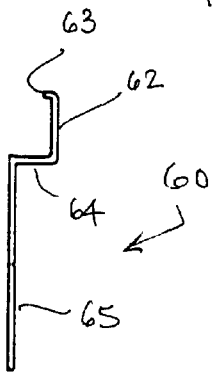
FIG. 6 shows a one-piece "z" type extrusion having a hook end for forming a connection to other one-piece extrusions.

In FIG. 6, a "Z" type extrusion 60 has a connector section 62 with a hook end 63, a right angle intermediate section 64, and an extension section 65. The hook end 63 is designed to interconnect with the hook indentation of the ramp 43 or 53 of a one-piece extrusion, such as the "H" or "J" type extrusion described above, in order to form a right angle connection thereto, such as to finish off a right angle or T-intersection of the building wall.

Figure 7:
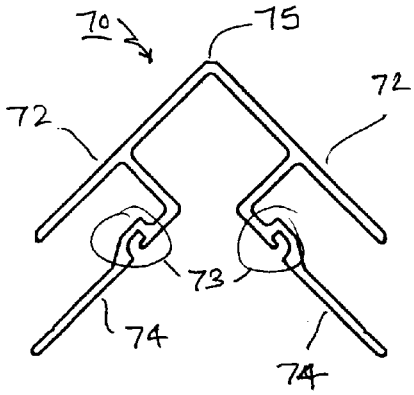
FIG. 7 shows a one-piece "O.C."-outside corner type extrusion for forming an outside corner.

In FIG. 7, a one-piece "C" type extrusion is shown having a front cover section 72 on each side of a right-angle bend 75, each of which forms a pocket with a respective base section 74 having a panel-funneling and screw-clearing ramp 73 provided therein, as described previously. This type of extrusion is used to terminate wall panels meeting at a right-angle outside corner. It may be formed from a straight extrusion, such as the embodiment shown in FIG. 4A, which is bent to form the outside corner. A straight "H" type extrusion can be bent as an inside or outside corner at a wide range of angles, to adjustably deal with edge situations that are not only right angles. "H" type extrusions may also be sawed in two to provide customized pieces to flexibly handle other edge situations that cannot be finished with the available extrusions.

The described types of extrusions can be combined together to deal with many different kinds of panel edge situations of a building. Two two-piece "J" extrusions can be combined to form an outside corner, as shown in FIG. 8A. Alternatively, a one-piece "C" type extrusion may be used. "J" and "Z" extrusions can be used together to form a horizontal fascia and soffit, as shown in FIG. 8B, or a vertical outside corner, as shown in FIG. 8C (a cover piece can be inserted in the indented cavity formed with the "Z" extrusion). The long leg of a "J" or "H" extrusion can be used to create a flashing to a coping cover at the end of a wall, as shown in FIG. 8D. A "J" type extrusion with a corner extension can be used alone or with other brake form shapes to terminate the horizontal end of a wall with a rain flashing, as shown in FIG. 8E.

Thus, a small number of extrusion types can be used in combination and by bending to handle a wide range of edge situations. Other types of extrusion shapes and combinations may of course be designed for other types of edge situations. The one-piece extrusions are made of metal and are painted to be available in a wide range of colors and textures. Extrusions of different colors can be combined to provide a two-toned joint. The extrusions connect together to provide a mechanically sturdy and visually strong finish that can enhances the appeal of a building or other types of wall structures.

It is understood that many modifications and variations may be devised given the above description of the principles of the invention. It is intended that all such modifications and variations be considered as within the spirit and scope of this invention, as defined in the following claims.

I claim:

1. An extrusion device for mounting a wall panel to an underlying wall structure comprising:

an outer cap provided with an outer surface extending to an edge on at least one lateral side thereof adapted to be positioned against an outer surface of a wall panel, said outer cap having a pair of spaced-apart insertion fingers projecting perpendicularly downward from an inner surface of said cap, and an inner receiver base having a planar mounting portion for mounting to the underlying wall surface and for receiving an end of a wall panel to be mounted thereon, said receiver base having a pair of angled receiver flanges spaced apart by a given width and projecting upwardly from an inner surface facing toward said cap, so as to receive the insertion fingers of said cap therein when said cap is positioned and inserted onto said base, wherein the outer cap is comprised of an insert cap provided at its inner facing side with an insertion plug having walls acting as said insertion fingers, said insertion plug being inserted between the receiver flanges, and a cover cap which snaps into a cavity formed on a front facing side of the insertion plug.

2. An extrusion device of claim 1, wherein the receiver base and cap have mounting and panel holding portions on both sides of a central portion where the insertion fingers and receiver flanges are engaged, which is used to form a joint between two wall panels.

3. An extrusion device of claim 1, wherein the receiver base and flanges are made of plastic and configured to yield under the force of inserting the insertion fingers.

4. An extrusion device of claim 1, wherein the outer cap and insertion fingers are made of metal, and the tips of the insertion fingers are beveled at a slight angle to allow easy insertion of the fingers into the receiver flanges.

5. An extrusion device of claim 4, wherein the slight angle is an angle $\alpha$ of about 7° to 14°.

6. An extrusion device of claim 1, wherein the receiver flanges are formed with beveled outer contact surfaces inclined toward tip ends facing a center cavity into which the insertion fingers are inserted, in order to center and guide their gradual insertion therein.

7. An extrusion device of claim 1, wherein the cap has compound water-shedding edges, having a rounded raindrip edge spaced in close proximity to a sharply inclined knife edge.

8. An extrusion device of claim 1, wherein the insertion fingers have a length and thickness to allow easy insertion into the receiver flanges and the receiver flanges are configured to yield under the force of inserting the insertion fingers.

9. An extrusion device of claim 1, wherein the insertion fingers have on their outer surfaces a plurality of detent positions for engagement of the receiver flange tips therein, in order to accommodate differing panel thicknesses.

10. An extrusion device of claim 1, having the receiver base and outer cap extending on one lateral side of the insertion fingers and receiver flanges, said cap being provided on an opposite lateral side thereof with a terminal flange that is offset by a slight distance from the receiver flange of the base.

11. An extrusion device for mounting a wall panel to an underlying wall structure comprising:

a rear base portion of a given extended width for mounting to an underlying wall structure and for holding an edge of a wall panel thereon, a front cover portion having a given width smaller than the base portion width and being spaced from the base portion so as to form a pocket therewith, and a ramp formed on a front facing surface of the base portion within the width of the front cover portion, said ramp acting to gradually force the edge of a wall panel inserted in the pocket toward the front cover portion of the extrusion clear of heads of screws used to mount the base portion to the underlying wall structure, wherein said base portion is formed with a hook indentation on a back side of the ramp on a rear surface of the base portion.

12. An extrusion device according to claim 11, wherein the ramp lies within the width of the front cover portion such that an edge of a wall panel of greater thickness can be inserted within the pocket but short of the ramp.

13. An extrusion device according to claim 11, having a pair of rear base portions and front cover portions extending on respective opposite lateral sides, which is used to form a joint between two wall panels.

14. An extrusion device according to claim 11, having a rear base portion and front cover portion extending on one lateral side, which is used to terminate the edge of a wall panel.

15. An extrusion device according to claim 14, having a section extending at an angle from the edge of the pocket that is used to form a beveled inside corner or a flashing at the end of a wall panel.

16. An extrusion device according to claim 11, including in combination therewith another extrusion which has a connector section with a hook end, a right angle intermediate section, and a straight section extending in parallel with the connection section, which is used to interconnect the hook end with the hook indentation on the back side of the ramp to form a right angle connection thereto.

17. An extrusion device according to claim 11, having a pair of rear base portions and front cover portions on each side of a right-angle corner.

18. An extrusion device according to claim 13, wherein said pair of rear base portions and front cover portions are bent at an angle to each other to form an angle joint between two wall panels.

* * * * *